US010065191B2

(12) United States Patent
Dick

(10) Patent No.: US 10,065,191 B2
(45) Date of Patent: Sep. 4, 2018

(54) TWIN ROLLER CRUSHER

(71) Applicant: Crush + Size Technology GmbH & Co. KG, Bergneustadt (DE)

(72) Inventor: Matthias Dick, Bergneustadt (DE)

(73) Assignee: CRUSH + SIZE TECHNOLOGY GMBH & CO KG, Bergneustadt (DE)

( * ) Notice: Subject to any disclaimer, the term of this patent is extended or adjusted under 35 U.S.C. 154(b) by 399 days.

(21) Appl. No.: 14/772,671

(22) PCT Filed: Mar. 6, 2014

(86) PCT No.: PCT/DE2014/100081
§ 371 (c)(1),
(2) Date: Sep. 16, 2015

(87) PCT Pub. No.: WO2014/161528
PCT Pub. Date: Oct. 9, 2014

(65) Prior Publication Data

US 2016/0030942 A1 Feb. 4, 2016

(30) Foreign Application Priority Data

Apr. 3, 2013 (DE) ..... 20 2013 101 419

(51) Int. Cl.
*B02C 4/00* (2006.01)
*B02C 4/08* (2006.01)
*B02C 4/30* (2006.01)

(52) U.S. Cl.
CPC . *B02C 4/08* (2013.01); *B02C 4/30* (2013.01)

(58) Field of Classification Search
CPC ..... B02C 4/08; B02C 4/30
USPC ..... 241/236, 293, 294
See application file for complete search history.

(56) References Cited

U.S. PATENT DOCUMENTS 1,537,163 A * 5/1925 Giunta ..... B02C 4/08 241/230
2,219,077 A * 10/1940 Pharo ..... D02G 3/20 19/65 R
2,578,540 A 12/1951 Gundlach
3,155,028 A * 11/1964 Morgenson ..... B02C 4/08 100/161
3,240,436 A * 3/1966 Mylting ..... B02C 4/08 241/230
3,474,973 A 10/1969 Gundlach
3,862,721 A * 1/1975 Flair ..... B02C 4/08 241/236
4,252,282 A * 2/1981 Vermeulen ..... A22C 17/06 241/236

(Continued)

FOREIGN PATENT DOCUMENTS

GB 1244390 9/1971

*Primary Examiner* — Faye Francis
(74) *Attorney, Agent, or Firm* — Andrew Wilford

(57) ABSTRACT

The invention relates to a dual-roller crusher (1) with rollers (2, 3) rotatably mounted in a crusher housing and are driven by a motor so as to counter-rotate synchronously about respective parallel center axes, crusher teeth (6, 7) being mounted on the outer surfaces of the rollers (2, 3), every crusher tooth (6, 7) of a roller (2, 3) of the pair of rollers being fittable into a respective pocket (8, 9) in the outer surface of the other roller (2, 3) of the pair of rollers such that, during rotation of the rollers (2, 3), each crusher tooth (6, 7) engages in the respective pocket (8, 9).

9 Claims, 4 Drawing Sheets

(56) References Cited

U.S. PATENT DOCUMENTS

| | | | | | |
|---|---|---|---|---|---|
| 4,359,193 | A * | 11/1982 | Schonert | B02C 19/0056 | 241/3 |
| 4,401,279 | A * | 8/1983 | DeVita | B02C 18/142 | 241/236 |
| 4,410,144 | A * | 10/1983 | Imperi | B02C 4/30 | 241/236 |
| 6,592,061 | B2 * | 7/2003 | Watajima | B02C 4/08 | 241/191 |
| 6,634,577 | B2 * | 10/2003 | Horigane | B02C 4/06 | 241/235 |
| 2008/0317933 | A1 * | 12/2008 | Williamson | B02C 4/08 | 426/629 |
| 2009/0294558 | A1 * | 12/2009 | Bihn | B02C 4/06 | 241/6 |
| 2014/0196616 | A1 * | 7/2014 | Schwelling | B30B 3/005 | 100/176 |

* cited by examiner

TWIN ROLLER CRUSHER

CROSS REFERENCE TO RELATED APPLICATIONS

This application is the US-national stage of PCT application PCT/DE2014/100081 filed 6 Mar. 2014 and claiming the priority of German patent application 202013101419.2 itself filed 3 Apr. 2013.

FIELD OF THE INVENTION

The invention relates to a dual-roller crusher with rollers rotatably mounted in a crusher housing and are driven by a motor so as to counter-rotate synchronously about respective parallel center axes, radially outwardly projecting crusher teeth being mounted on the outer surfaces of the rollers.

BACKGROUND OF THE INVENTION

Dual-roller crushers are known and common particularly in the field of comminution in mining. In conventional dual-roller crushers, the size reduction of coarse rock or the like is done by two motor-driven rollers. As a rule, the rollers are horizontally aligned, with their central axes parallel to each other. The two rollers rotate in opposite directions of rotation such that the material to be crushed, which as a rule is supplied from above to the nip, is drawn into the nip by the rotation of the rollers and crushed by the crusher teeth. The material is then discharged downward from the nip. It is typical for crusher teeth to be mounted on the roller faces for the reduction in size of the supplied material to occur. The crusher teeth are provided with differing arrangements from one another on the roller faces. They are preferably arranged such that the teeth of one roller do not collide with the crusher teeth of the other roller during rotation of the rollers.

A synchronization of the rollers by a gear is also known.

In classic dual-roller crushers there exists an imaginary tangential opening angle between the two roller surfaces where the feed material is wedged and crushed between the rollers. A roller surface without teeth draws in the material for wedging of the feed material. In this case, only rock which is small in comparison to the size of the diameter of the rollers can be comminuted. The working tangential opening angle here is very small. The use of crusher teeth can significantly improve catchment depending on the geometry. Crusher teeth can have a wide variety of shapes, for example, they may be pointed teeth or chisel-like or fin-like crusher teeth that are fixed in a holder on the roller surface, preferably interchangeably, and such crusher teeth may have, for example, hardened tips and preferably project approximately tangentially to the outer surface. In conventional dual-roller crushers, the grain size achieved by reduction in size of the supplied materials by the dual-roller crusher is determined by the nip. The nip is in turn dependent on the tooth size. A large nip with correspondingly large teeth on the roller surface means that the final grain size after leaving the dual-roller crusher is relatively large. This means that in practice, a pre-crushing dual-roller crusher with relatively large teeth is used. Thereafter, however, post-crushing with a second dual-roller crusher is necessary, the second dual-roller crusher having smaller teeth so that its nip is smaller.

OBJECT OF THE INVENTION

Starting from this prior art, the object of the invention is to create a dual-roller crusher that provides a significantly larger crushing ratio between supplied material and discharged material, that is extremely economical, and that does not necessitate a further second dual-roller crusher in order to obtain the final grain size.

SUMMARY OF THE INVENTION

To achieve this object, the invention proposes that each crusher tooth of a roller of the roller pair is associated with a respective pocket in the outer surface of the other roller of the roller pair, in such a way that during rotation of the rollers, the crusher tooth engages into the respective pocket.

With the inventive construction, it is possible to outfit the dual-roller crusher with relatively large crusher teeth, while however the nip between the rollers of the dual-roller crusher can be set very small. Due to the fact that each crusher tooth on a roller of the roller pair has a respective pocket in the outer surface of the other roller pair into which the respective crusher tooth of the other roller can engage, it is possible on the one hand that the crusher teeth may be big, so that they are able to also reduce in size coarse supplied material and push this into the nip. On the other hand, the possibility is provided by this arrangement to set the nip between the rollers relatively narrow. This has the result that large chunks of material to be crushed can be supplied and crushed, and the final grain size of the material to be crushed can be achieved in a single pass through the dual-roller crusher.

It is hereby preferably provided that the pocket size and depth conforms TO the shape and size of the respective crusher tooth.

It is also preferably provided that each pocket is dimensioned such that during rotation of the rollers, the respective crusher tooth engages therein without touching the pocket floor.

In particular, it is preferably provided that the pocket and the crusher teeth are complementary to one another such that during rotation of the rollers, a clearance gap between the roller surfaces exists that is smaller than the height of the crusher teeth.

With the embodiment according to the invention the geometric extension of the crusher teeth does not collide with the roller surface of the other respective roller, however the closest possible convergence of the two rollers is possible for reducing the nip formed between them. To ensure that no collision occurs, the respectively opposite roller for each crusher tooth has a recess into which the tooth can engage without touching the roller surface. The geometry of the respective pocket or recess results from the movement curve of the crusher tooth relative to the roller body. In the dual-roller crusher according to the invention, a synchronization of the roller drive occurs, for example by a split gear. With the embodiment according to the invention, a very large size reduction ratio is achieved, for example up to 1:20. With respect to the conventional embodiment, the use of a second dual-roller crusher for achieving the final grain size is also avoided. Economic efficiency is thus significantly increased. The necessary space requirements are also reduced, and utilization of the corresponding machine, i.e. the dual-roller crusher, is improved. Regardless of the positioning of the crusher teeth, this principle according to the invention can be carried out for all possible tooth positions of the crusher teeth on the roller surface. For example, axially aligned arrangements on the roller surface, spirally offset arrangements, positive or negative v-shaped arrangements symmetrical with respect to the roller center, irregular arrangements, circumferentially chaotic arrangements on the roller surface are known.

Under certain circumstances, it may be advantageous if additional crushing projections are provided on the face of the rollers, whose heights are smaller or the same as the clearance gap between the rollers.

In this embodiment, additional crushing projections on the roller surface are preferably provided on both roller surfaces. These crushing projections are arranged offset on the roller surfaces relative to each other, so that they do not meet one another during rotation of the rollers. Such crushing projections only have a relatively low height in comparison with the crusher teeth, however they serve to further reduce in size particles that has been drawn into the nip. This post-reduction in size by the small teeth occurs without pockets for these teeth. The roller spacing is only increased by these by a small amount. A nip is necessary in any case for passing through the material that has been crushed. This distance may be used by the arrangement of additional crushing projections.

In this embodiment also the crusher teeth and optionally also the crushing projections are rowed along outer circumferential lines, and each roller is formed with a plurality of outer circumferential lines of crusher teeth and optionally of crushing projections spaced axially and extending parallel to each other.

It may also be provided that the circumferential lines are formed by annular ridges on the roller surface that carry the crusher teeth and optionally the crushing projections.

In addition, the crusher teeth and optionally the crushing projections of one roller are axially offset on the surface thereof with respect to the crusher teeth and optionally the crushing projections on the surface of the other roller.

BRIEF DESCRIPTION OF THE DRAWING

Embodiments of the invention are shown in the drawings and described in more detail below.

FIELD OF THE INVENTION

Figure 1:
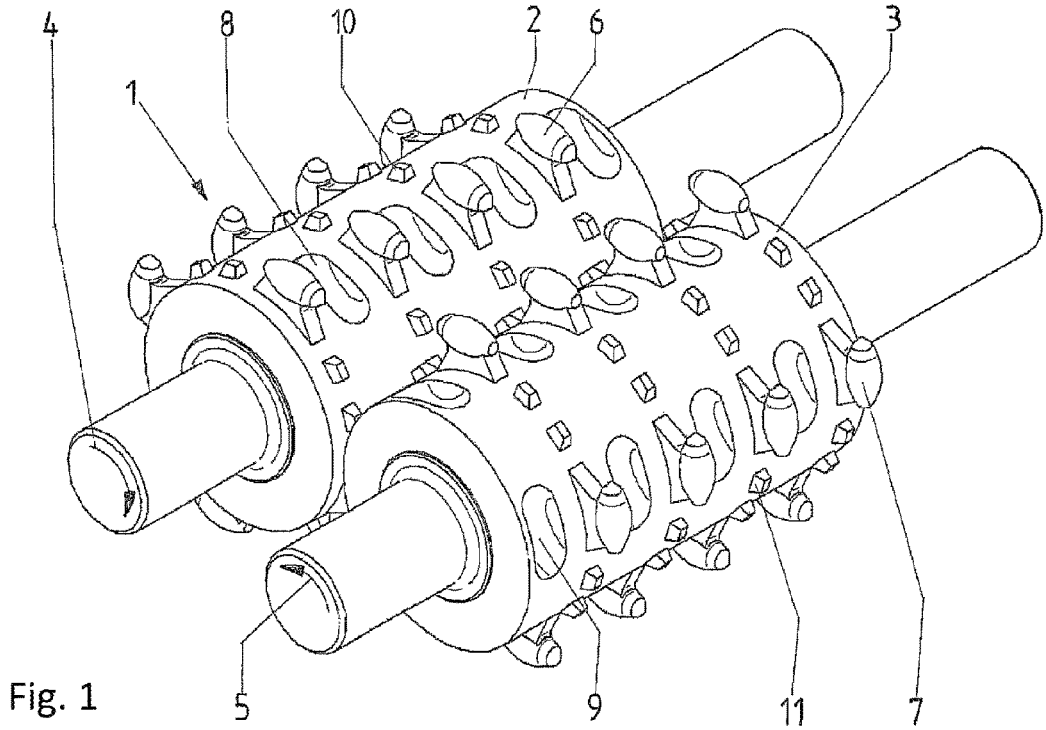
FIG. 1 is a view of the essential components of a dual-roller crusher.
Figure 2:
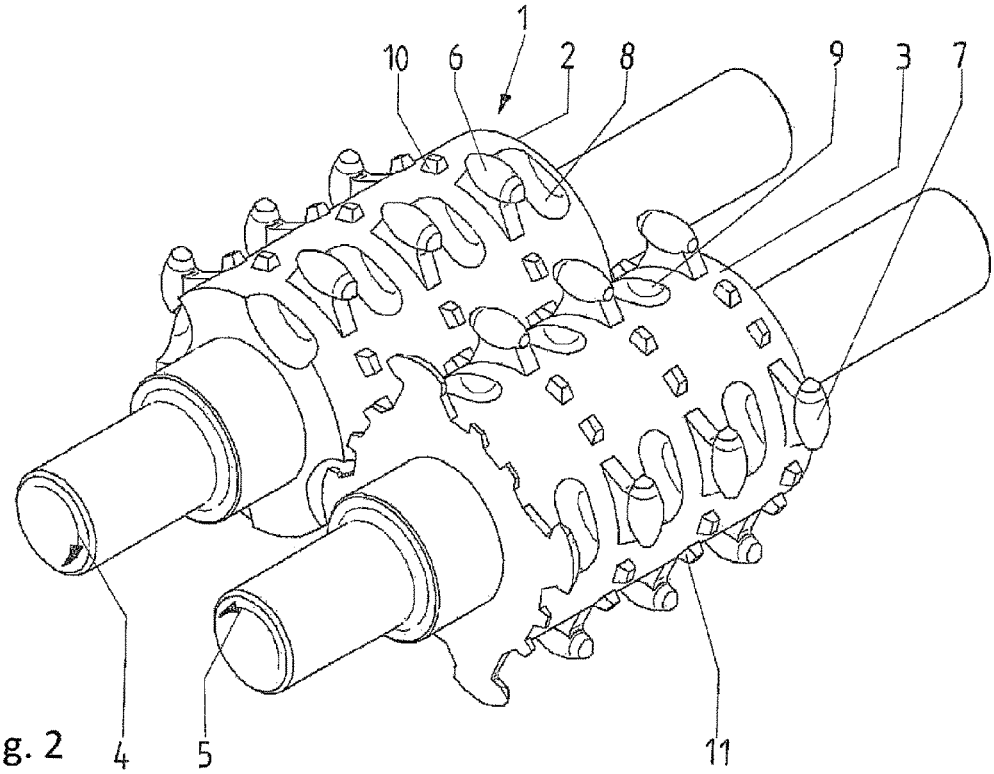
FIG. 2 is the a same view, partly broken away.
Figure 3:
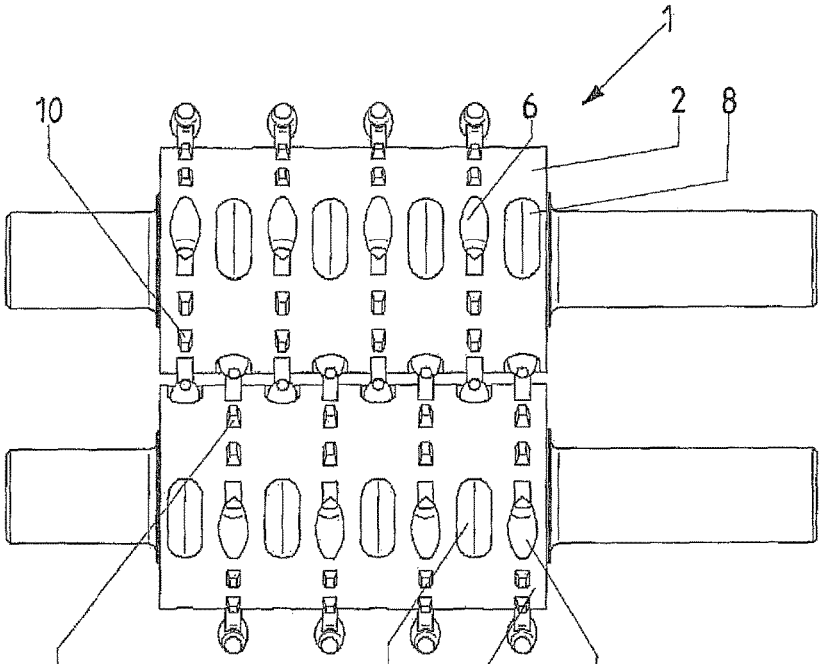
FIG. 3 is a top view.

The drawings show the essential inventive elements of a dual-roller crusher 1. Such a dual-roller crusher comprises two rollers 2 and 3 rotatably mounted and driven by a motor so as to counter-rotate synchronously. Here, the rollers 2 and 3 have shaft stubs on their axial end faces that are mounted in a crusher housing and are driven so as to counter-rotate synchronously corresponding to the respective directional arrows 4 and 5 by a suitable motor drive. The central axes of the two rollers 2 and 3 are parallel to each other. Normally, such dual-roller crushers are outfitted with horizontally oriented rollers 2 and 3, and the material to be crushed is introduced from above and drawn into the nip between the rollers 2 and 3, while the material that has been crushed is discharged below.

Crusher teeth 6 and 7 are mounted as a plurality of individual elements on the surface of the rollers 2 and 3 and project radially outward from the outer surface of the respective rollers 2 and 3. According to the invention, a corresponding number and arrangement of pockets 8 and 9 are provided in the rollers 2 and 3 so that during rotation of the rollers 2 and 3, the crusher teeth 6 or 7 of each roller each engage in a respective one of the pockets 8 and 9 of the other roller. The size and depth of the pockets 8 and 9 conforms to the shape and size of the respective crusher tooth 6 or 7, in particular in such a manner that each crusher teeth 6 and 7 of each roller does not contact the other during rotation of the rollers 2 and 3, but rather engages more or less without contact in the respective pocket 8 or 9, fits therein, and then withdraws therefrom.

Figure 4:
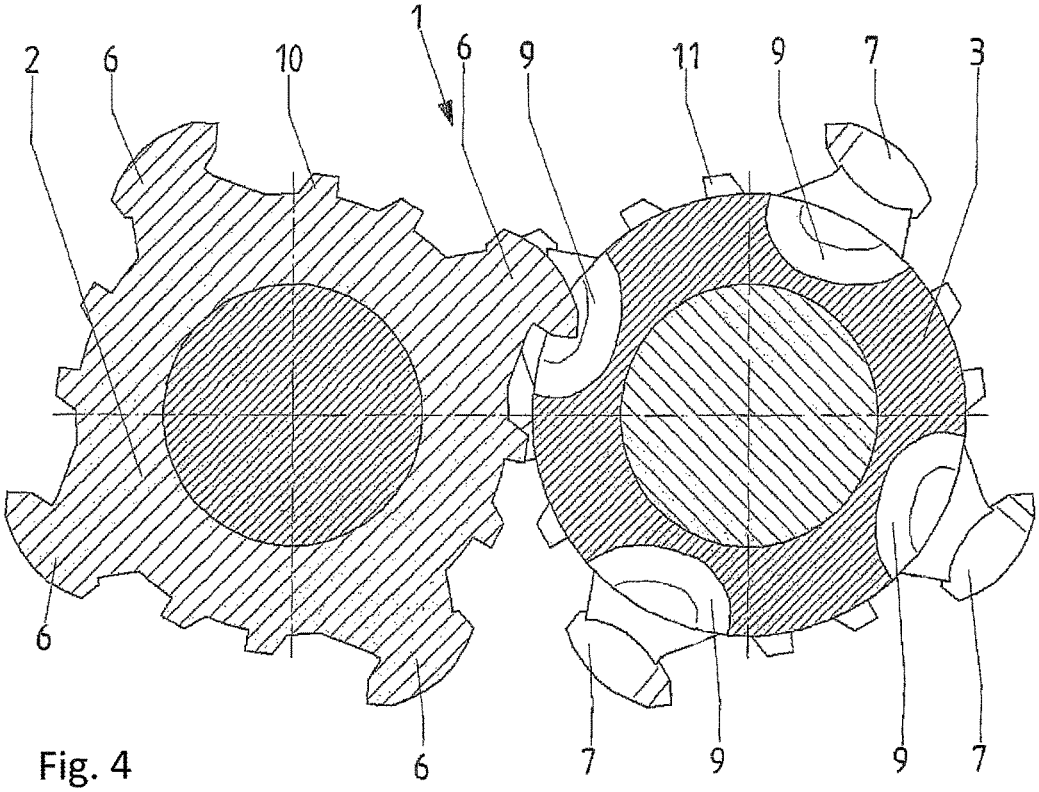
FIG. 4 is a section in a first operating position.
Figure 5:
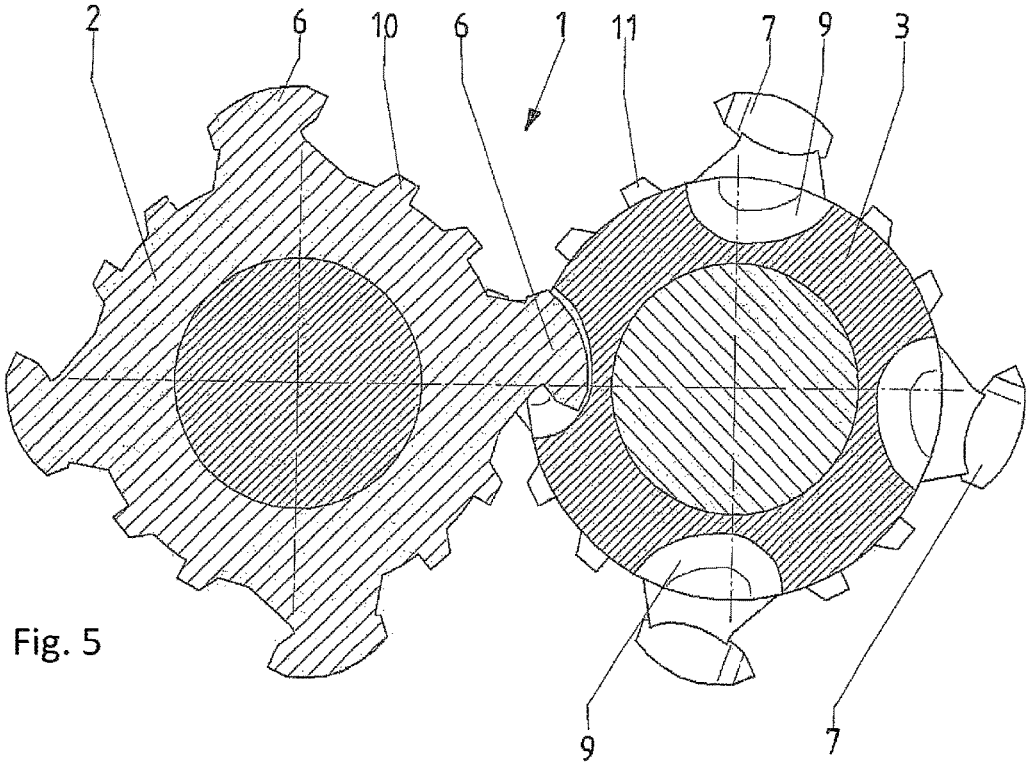
FIGS. 5 and 6 are further sections in consecutive operating positions.
Figure 6:
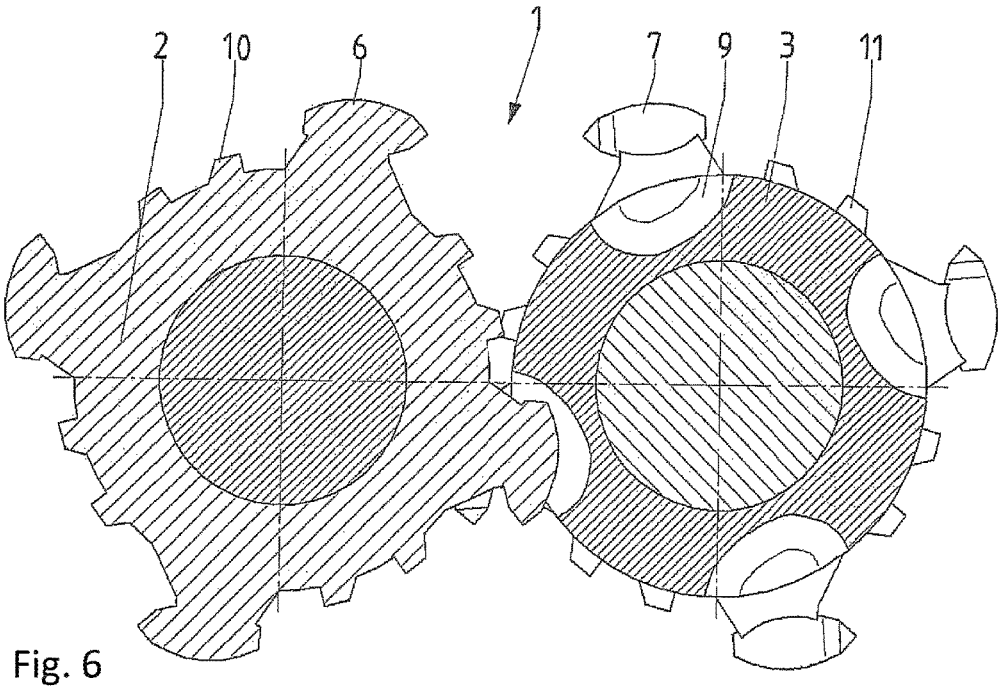

As can be seen for example in FIGS. 4 to 6, the pockets 8 and 9 and the crusher teeth 6 and 7 are adapted to each other in size and arrangement, so that during rotation of the rollers 2 and 3, a clearance gap is observed between the roller surfaces that is smaller than the height of the crusher teeth 6 and 7.

Furthermore, additional crushing projections 10 and 11 formed on the surfaces of the rollers 2 and 3 have radial heights that are significantly smaller than the radial heights of the crusher teeth 6 and 7, and that do not mate with respective pockets. The height of these additional crushing projections 10 and 11 is slightly less than the width of the nip between the rollers 2 and 3, so that these may pass through the nip during operation of the dual-roller crusher without contacting the respectively opposite roller. These additional crushing projections are useful in order to further reduce the size of the material crushed by the crusher teeth 6 and 7 and the rollers 2 and 3, so that in the end result, a reduction in size to the final grain size can occur.

Figure 7:
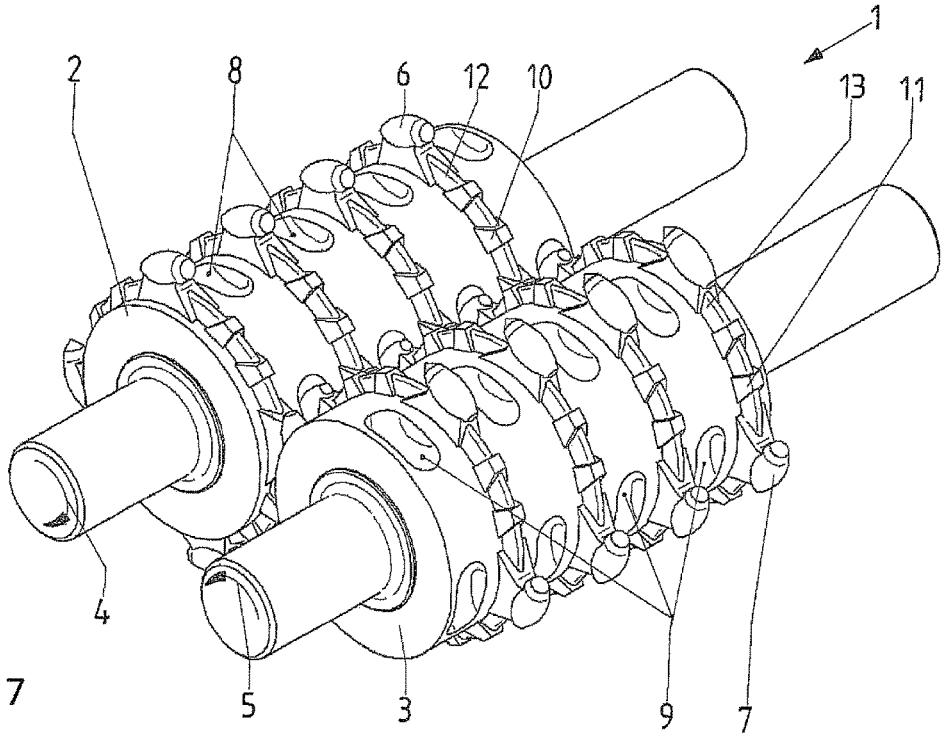
FIG. 7 shows a variant in the view as in FIG. 1.
Figure 8:
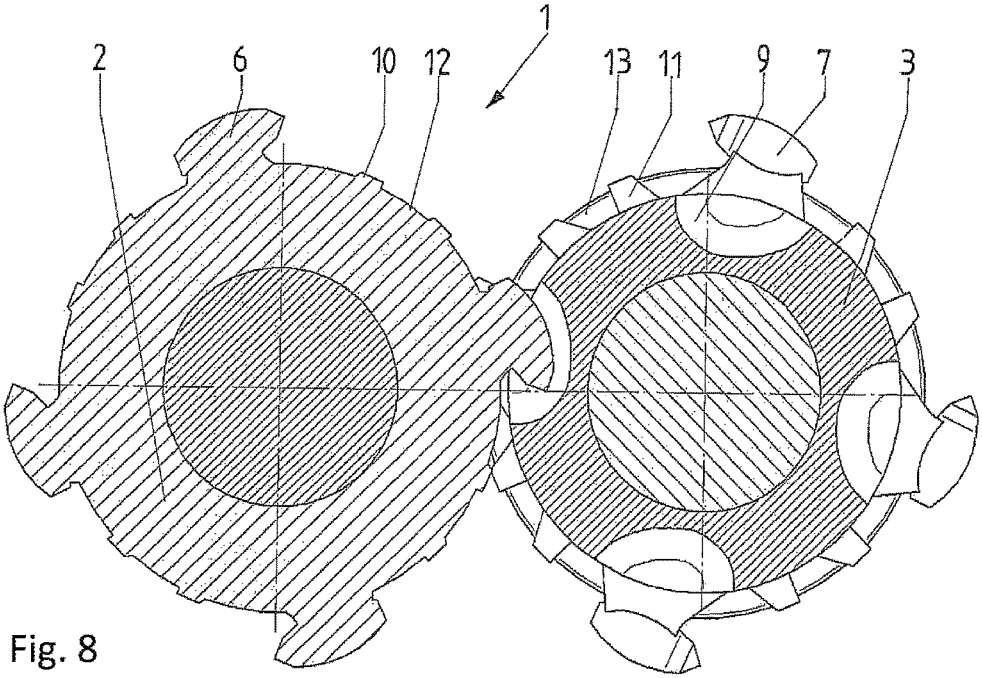
FIG. 8 is a section through the variant.

As is apparent from the drawing, the crusher teeth 6 and 7 as well as the crushing projections 10 and 11 are arrayed in rows extending along respective annular circumferential lines, and each roller has a plurality of outer circumferential annular tooth rows that are parallel to one another and spaced apart from one another and that have the crusher teeth 6 and 7 and crushing projections 10 and 11. Such annular rows are formed in the embodiment of FIGS. 7 and 8 by annular ridges 12 and 13 on the surfaces of the rollers 2 and 3, these annular elevations 12, 13 carrying the crusher teeth 6 and 7 and the crushing projections 10 and 11. Between these annular ridges 12 and 13, the roller surface is smooth and recessed and formed with the pockets 8 and 9.

As can be seen from the illustrated embodiments, the crusher teeth 6 and 7 and the crushing projections 10 and 11 of one roller are respectively axially offset on the surface thereof with respect to the crusher teeth and the crushing projections on the surface of the other roller.

The invention is not limited to the illustrated embodiments, but rather the scope of the disclosure is variable in many ways.

All singular or combined features disclosed in the specification and/or drawings are considered essential to the invention.

The invention claimed is:

1. A dual-roller crusher comprising:

a crusher housing;

a pair of roller bodies rotatable about respective parallel axes, mounted in the crusher housing, and having respective outer cylindrical surfaces spaced apart by a clearance gap;

a motor synchronously counter-rotating the roller bodies about the respective axes; and radially outwardly projecting crusher teeth mounted on the outer cylindrical surfaces of the pair of roller bodies, each crusher tooth of each roller body of the pair of rollers being paired with a pocket in the outer surface of the other roller body of the pair such that, during rotation of the pair of roller bodies, each crusher tooth can engage in the respective pocket of the other roller body, each crusher tooth projecting from the respective roller body by a radial tooth height greater than the clearance gap.

2. The dual-roller crusher according to claim 1, wherein a size and depth of each pocket is complementary to a shape and size of the respective crusher tooth.

3. The dual-roller crusher according to claim 1, wherein each pocket is dimensioned such that, during synchronous rotation of the pair of roller bodies, each crusher tooth is engaged in the respective pocket without touching a floor thereof.

4. The dual-roller crusher according to claim 1, further comprising:

additional crushing projections on the outer surfaces of the pair of roller bodies and having radial heights smaller or the same as the clearance gap between the pair of roller bodies.

5. The dual-roller crusher according to claim 4, wherein the crusher teeth and the crushing projections are rowed along outer circumferential lines on the respective pair of roller bodies, and each roller body is provided with a plurality of the outer circumferential rows of crusher teeth and crushing projections spaced and parallel to each other.

6. The dual-roller crusher according to claim 5, wherein the circumferential lines are formed by annular elevations on an outer surface of the respective roller body carrying the crusher teeth and the crushing projections.

7. The dual-roller crusher according to claim 4, wherein the crusher teeth and the crushing projections of each roller body are axially offset on the surface thereof with respect to the crusher teeth and the crushing projections on the surface of the other roller body.

8. The dual-roller crusher according to claim 1, wherein each pocket is open only radially outwardly.

9. The dual-roller crusher defined in claim 1, wherein the clearance gap is measured perpendicular to the axes and on a plane including both of the axes.

* * * * *